US007413535B2

(12) United States Patent
Schneider

(10) Patent No.: US 7,413,535 B2
(45) Date of Patent: Aug. 19, 2008

(54) METHOD FOR MANUFACTURING TAMPER EVIDENT RECLOSABLE PLASTIC BAGS

(75) Inventor: John H. Schneider, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 1173 days.

(21) Appl. No.: 09/916,546

(22) Filed: Jul. 27, 2001

(65) Prior Publication Data

US 2003/0022778 A1 Jan. 30, 2003

(51) Int. Cl.
*B31B 1/90* (2006.01)
*B65B 61/18* (2006.01)

(52) U.S. Cl. ..... 493/394; 53/412

(58) Field of Classification Search ..... 493/394, 493/212–214; 53/412, 133.4, 451, 551, 552, 53/416, 139.2
See application file for complete search history.

(56) References Cited

U.S. PATENT DOCUMENTS

| | | | | | |
|---|---|---|---|---|---|
| 4,909,017 | A * | 3/1990 | McMahon et al. | ..... | 493/213 |
| 5,023,122 | A * | 6/1991 | Boeckmann et al. | ..... | 24/585.12 |
| 5,509,735 | A | 4/1996 | May | ..... | 383/210 |
| 5,513,915 | A | 5/1996 | May | ..... | 383/210 |
| 5,647,671 | A * | 7/1997 | May | ..... | 493/210 |
| 5,972,396 | A | 10/1999 | Jurgovan et al. | ..... | 426/106 |
| 6,044,621 | A | 4/2000 | Malin et al. | | |
| 6,099,451 | A * | 8/2000 | Mulder et al. | ..... | 493/213 |
| 6,115,892 | A * | 9/2000 | Malin et al. | ..... | 24/400 |
| 6,131,369 | A * | 10/2000 | Ausnit | ..... | 493/213 |
| 6,151,868 | A * | 11/2000 | Matthews | ..... | 53/451 |
| 6,212,857 | B1 * | 4/2001 | Van Erden | ..... | 493/213 |
| 6,224,262 | B1 | 5/2001 | Hogan et al. | ..... | 383/203 |
| 6,251,209 | B1 * | 6/2001 | Johnson | ..... | 493/213 |

FOREIGN PATENT DOCUMENTS

| | | |
|---|---|---|
| EP | 0 873 856 A2 | 10/1998 |
| EP | 0 873 856 A3 | 7/1999 |
| EP | 1 053 948 A2 | 11/2000 |
| EP | 1 053 948 A3 | 4/2001 |
| EP | 1 201 552 A2 | 5/2002 |
| EP | 1 201 552 A3 | 5/2003 |
| WO | 99/59872 | 11/1999 |

* cited by examiner

*Primary Examiner*—J. Gregory Pickett
(74) *Attorney, Agent, or Firm*—Day Pitney LLP

(57) ABSTRACT

The method of forming a tamper-evident plastic bag or similar container includes providing a zipper with interlocking first and second profiles with respective first and second flanges. The second flange is longer than the first flange. A distal portion (with respect to the interlocking elements of the profiles) of the second flange is sealed to the web thereby forming a transport seal to carry the zipper with the web through a form, fill and seal machine. At the form fill and seal machine hard seals are formed between the web and the first flange and a proximal portion of the second flange. The transport seal is a peel seal or alternatively the second flange is formed with a frangible section between the distal and proximal portions and the transport seal is a hard seal. In both cases the second flange provides tamper evidence and/or a hermetic barrier for the completed bag.

12 Claims, 3 Drawing Sheets

METHOD FOR MANUFACTURING TAMPER EVIDENT RECLOSABLE PLASTIC BAGS

BACKGROUND OF THE INVENTION

1. Field of the Invention

This invention relates to the manufacture of reclosable packaging and, in particular to a method of sealing a zipper to a bag making film to permit simultaneous transport of the zipper and film to a bag making machine such that the transport seal provides tamper evidence and/or hermetic sealing for the final bag.

2. Description of the Prior Art

Reclosable plastic bags are growing increasingly popular both for storage purposes and as primary packaging for cheese and various other food stuffs and other products. Such bags are formed with plastic zipper having profiles with mating interengageable elements. Where the bag is to be used as primary packaging for foods, it is often necessary to seal the product hermetically. While zipper elements can provide a secure closure, they cannot provide a hermetic closure. Accordingly, a separate hermetic seal is necessary. Even where a hermetic seal is not required, it is common-place to provide a separate, one-time seal on reclosable packaging for foods and other products that provides evidence of tampering. That is, the consumer looks to the unopened seal as evidence that the package has not been tampered with.

SUMMARY OF THE INVENTION

The present invention relates to a method for forming a reclosable plastic bag or container in a form fill and seal apparatus wherein the zipper, which may include a slider, is attached to the bag making film web prior to the web being brought into the form fill and seal apparatus. The zipper is attached to the bag making film by sealing a distal portion of a flange of one of the profiles. That flange being longer than a corresponding flange of the other profile. This seal forms a transport seal by which the zipper is transported with the bag making film into the bag making machine and further forms the hermetic and/or tamper evident seal of the completed bag.

The transport seal is a tamper evident and/or hermetic seal formed typically by way of a peel seal, frangible score line or a capped line of perforations, all of which may readily be ruptured by the consumer upon the first opening of the bag.

DESCRIPTION OF THE DRAWINGS

Objects and advantages of the present invention will become apparent from the following description and claims, and from the accompanying drawings, wherein:

DETAILED DESCRIPTION OF THE PREFERRED EMBODIMENT

Figure 1:
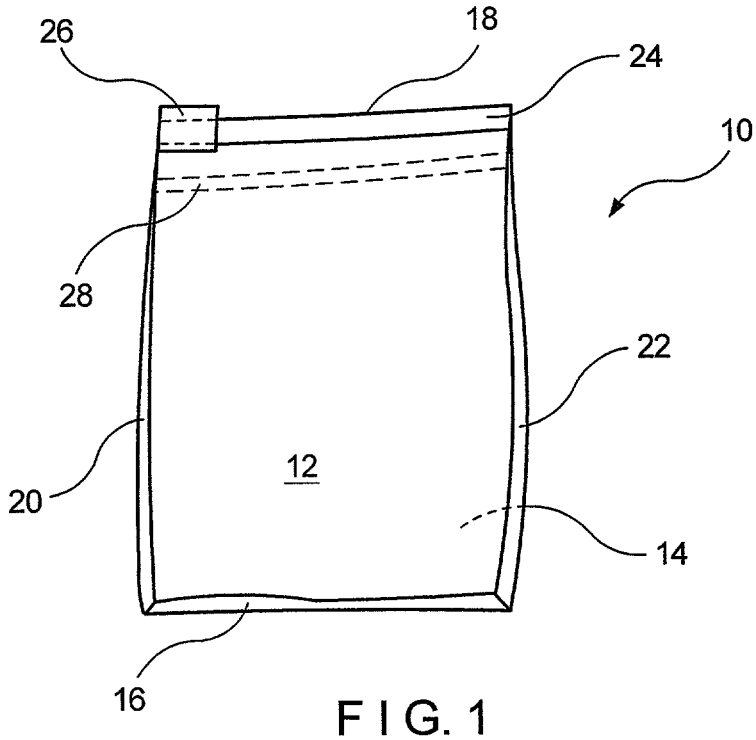
FIG. 1 is a front elevational view of a reclosable bag or package made in accordance with the present invention.
Figure 2:
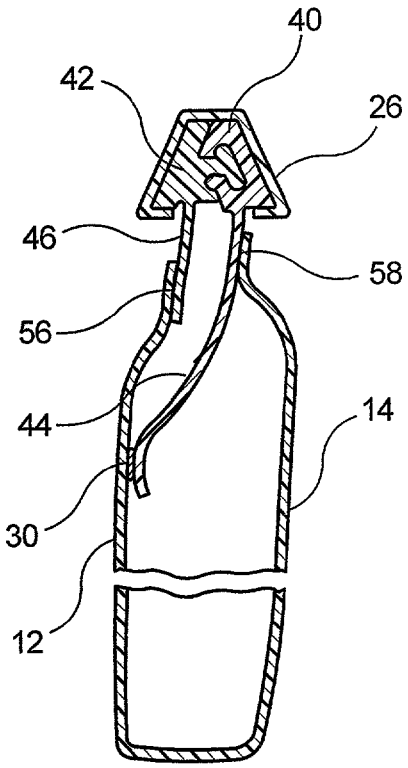
FIG. 2 is a schematic sectional view of a first embodiment of the reclosable bag of FIG. 1 wherein the hermetic or tamper evident seal comprises a peel seal.
Figure 3:
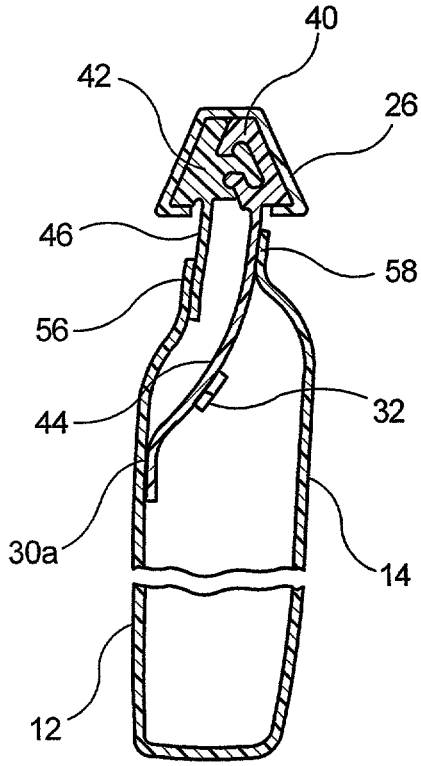
FIG. 3 is a schematic sectional view of an alternative embodiment of the reclosable bag of FIG. 1 wherein the hermetic or tamper evident seal comprises a capped line of perforations.

Reference is now made to the drawings and to FIG. 1 in particular wherein a reclosable plastic bag 10 is depicted comprising front and rear walls 12, 14, a bottom 16, top 18 and sides 20, 22. A zipper 24 extends across the bag top from side to side. A slider 26 can be provided on the profiles of the zipper to facilitate opening and closing the interengaging elements of the profiles. Within the bag 10 there is provided a tamper evident seal 28 that may also provide a hermetic seal. Seal 28 is such that the once opened, it can not be resealed, thereby providing evidence to a consumer if the bag had previously been opened. Seal 28 may comprise a peel seal 30 (as shown in FIG. 2) or a frangible seal 32 (as shown in FIG. 3). The frangible seal 32 may comprise a capped line of perforations as disclosed and described in U.S. Pat. No. 5,023,122.

Figure 4:
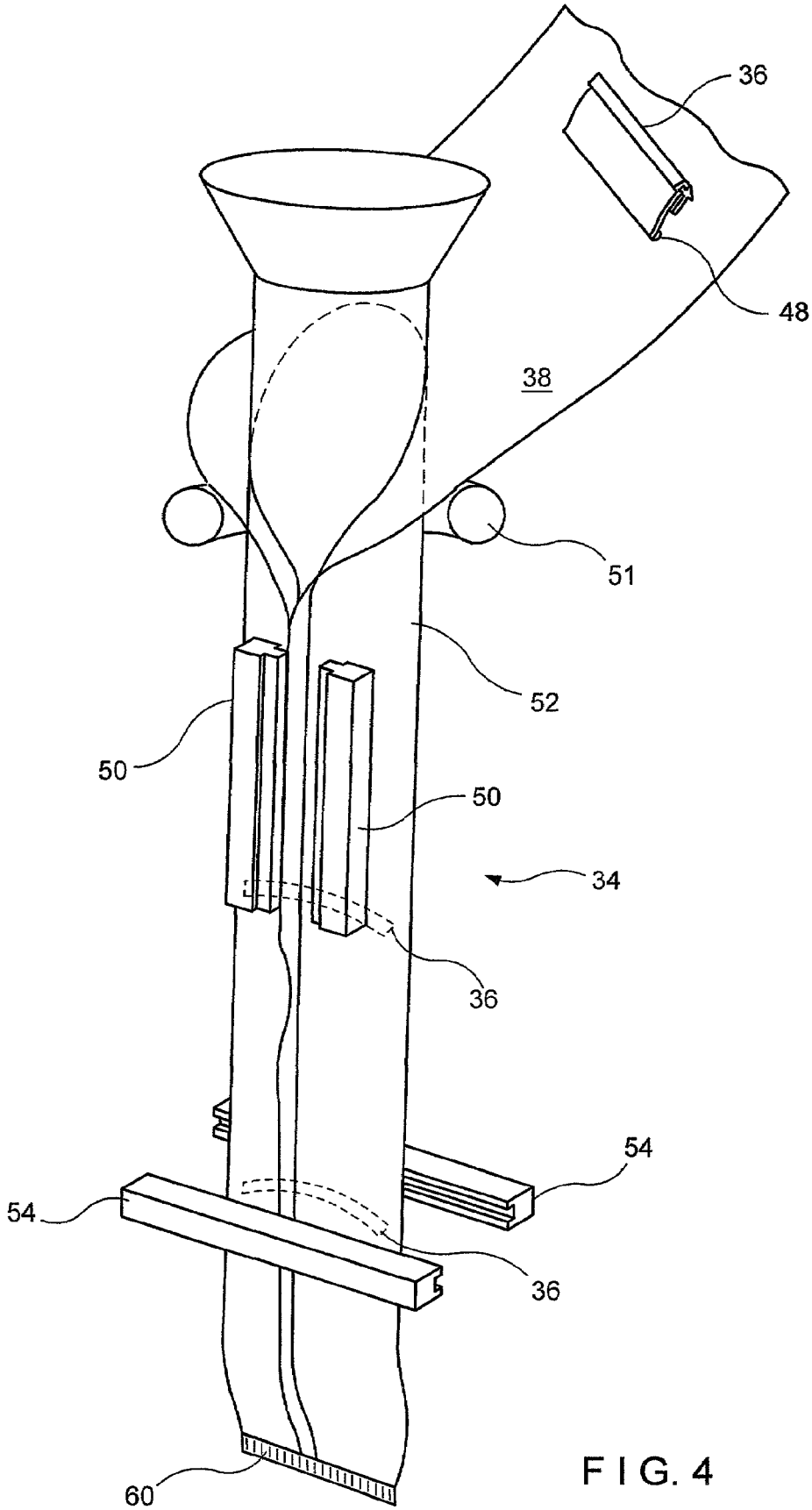
FIG. 4 is a schematic perspective view of the manner of forming the bag or package of FIG. 1 on form, fill and seal equipment.
Figure 5:
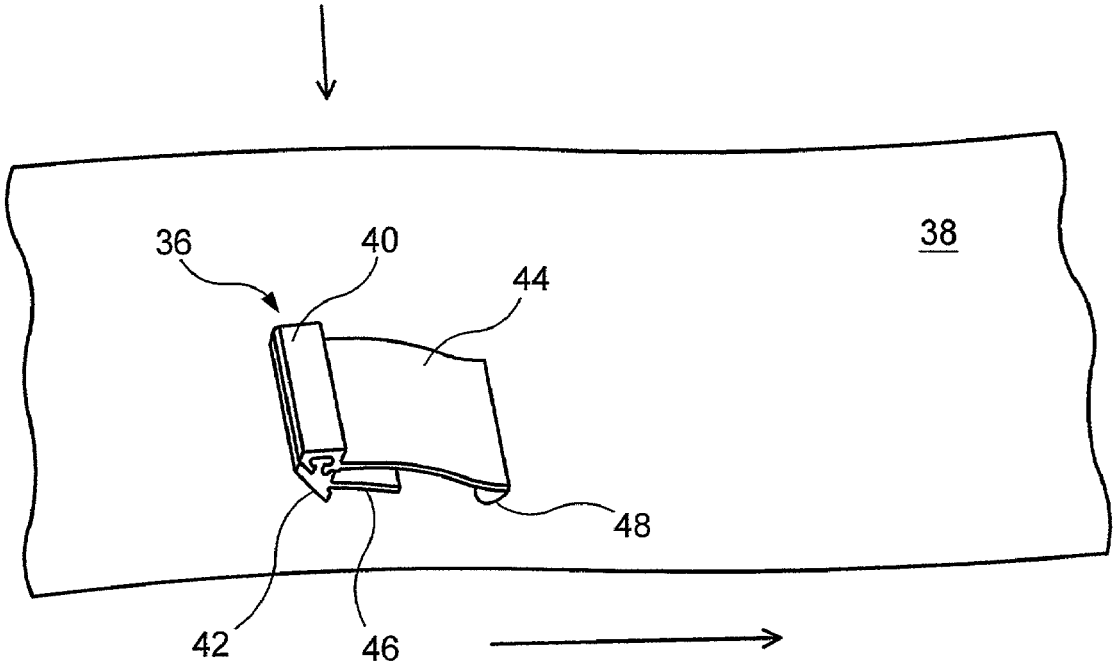
FIG. 5 is a perspective view of a zipper secured to a bag making film for use in making the bag of FIG. 2.
Figure 6:
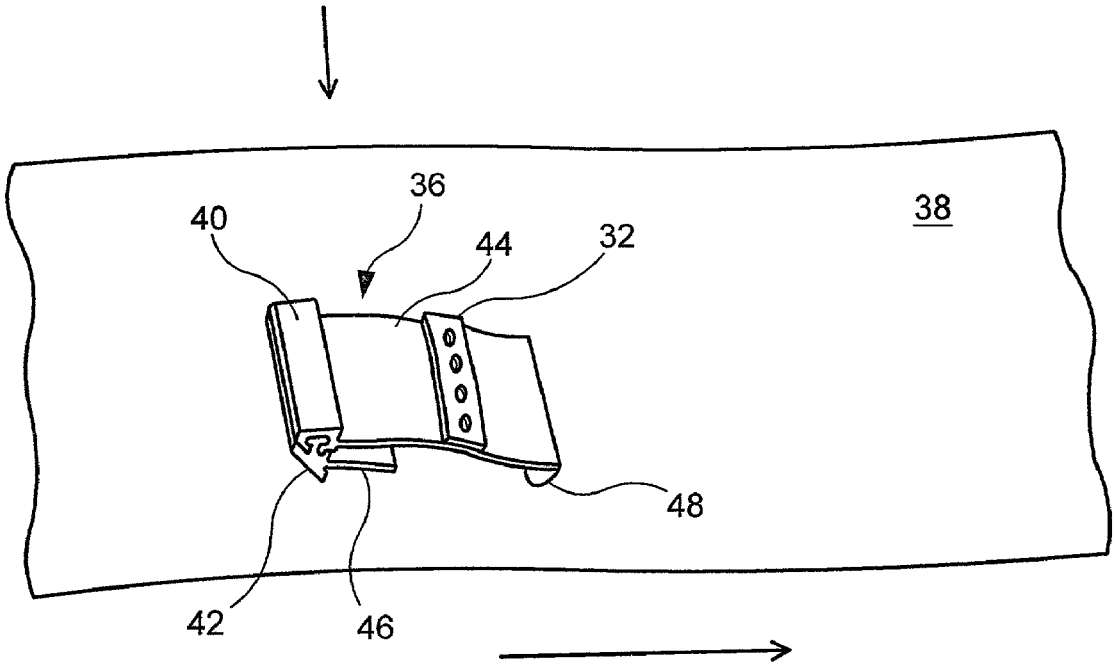
FIG. 6 is a perspective view of a zipper secured to a bag making film for use in making the bag of FIG. 3.

Reference is now made to FIG. 4 where there is depicted an apparatus 34 for producing the reclosable plastic bag 10 in the manner that is generally described in U.S. Pat. No. 4,909,017. In accordance with the disclosed method which is illustrated in simplified form in FIG. 4 of the present specification, zipper segments 36 having interlocked profiles are fed transversely across a web of bag making film 38 at intervals spaced apart from each other by a distance corresponding substantially to the depth of the desired final bag. One profile 40 is positioned atop the other profile 42. The top profile has a flange 44 that is longer than the corresponding flange 46 of the bottom profile 42 and the longer (top) flange 44 is sealed to the web 38 by a seal 48 at a portion of flange 44 that is distanced from the interlocking element of flange 44. The seal 48 serves as a transport seal that holds the zipper segment 36 to the web of bag making film as the web feeds through the bag making equipment and particularly as the web passes over a forming collar that transforms the flat web of bag making film into a tube. Accordingly it is desirable to position seal 48 close to the leading edge of flange 44. The length of zipper segment 36 is equal to approximately half the width of the bag making film bag 38.

At the bag making machine 34 the web of bag making film passes over collar 51 and is transformed into a tube 52. The edges of the bag making film are sealed together with seal bars 50 after which the profiles 40 and 42 of the zipper are attached to opposite sides of the inner surface of the tube by seal bars 54. Seal bars 54 form a hard seal 56 between flange 46 and the portion of the tube forming the bag front bag wall 12 and a hard seal 58 between flange 44 and the portion of the tube forming the bag rear wall 14. The seal 58 is closer to the interlocking member of profile 40 than is the seal 48. At the same time that they seal the profiles to the tube, seal bars 54 also form the cross seal 60 for the bottom of the next bag to be formed.

In accordance with the present invention, the transport seal 48 (i.e. the seal that holds the zipper segment to the bag making film as it feeds into the form, fill and seal equipment) is also a seal that provides for a tamper evident and/or hermetic seal for the contents of the finished bag. To this end, seal 30 (s shown in FIG. 2) may comprise a peel seal thus providing the tamper evident/hermetic seal for the interior of the package shown in FIG. 2. Alternatively, seal 30*a*, (as shown in FIG. 3) may comprise a hard seal in which case a frangible section 32 of flange 44 is positioned between hard seals 30*a* and 58. Since the frangible section must be ruptured to gain access to the interior of the package, it forms a tamper evident seal for the package contents.

Thus, in accordance with the above the desired objectives of the present invention are met.

Having thus described the invention, what is claimed is:

1. A method for producing a tamper-evident reclosable plastic bag comprising the steps of:

providing a zipper with first and second zipper profiles that include mating interlocking members, said first and second zipper profiles further including separate first and second flanges, respectively, said second flange being longer than said first flange and said second flange including a proximal portion and a distal portion with a tamper evident feature interposed between said proximal and distal portions, said proximal portion being more closely spaced to said second profile interlocking member than said distal portion, wherein a slider is positioned over said interlocking members;

positioning said zipper on a web of bag making film with said second interlocking zipper member atop said first interlocking zipper member with said first and second flanges extending in a longitudinally moving direction of said web thereby orienting said zipper in a direction transverse to a machine direction of said web to a form, fill and seal machine;

securing said second flange distal portion to said web spaced from said first flange in said longitudinally moving direction of said web; and transporting said web in said longitudinally moving direction to said form fill and seal apparatus.

2. The method in accordance with claim 1 wherein said first flange is hard sealed to said web and said proximal portion of said second flange is hard sealed to said web after said web is formed into a tube.

3. The method of claim 1 wherein said second flange distal portion is sealed to said web with a peel seal.

4. The method of claim 1 wherein said second flange tamper evident feature comprises a frangible section between said distal portion and said proximal portion and said distal portion is sealed to said web with a hard seal.

5. The method of claim 4 wherein said frangible section includes a perforated line.

6. The method of claim 5 wherein said perforated line is covered by a frangible cap layer.

7. The method of claim 4 wherein said frangible section includes a scored or thinned line of weakness.

8. The method of claim 1 comprising the further step of sealing said first flange to said web.

9. The method of claim 8 comprising the further step of sealing said proximal portion of said second flange to said web.

10. A bag formed by the method of claim 1.

11. The method of claim 1, wherein said distal portion of said second flange is secured to said web spaced apart from said distal portion of said first flange.

12. The method of claim 1, wherein during securing of said second flange to said web said first flange remains unsecured to said web.

* * * * *